US005606804A

United States Patent [19]

Smith et al.

[11] Patent Number: 5,606,804

[45] Date of Patent: Mar. 4, 1997

[54] MICROWAVE CLOTHES DRYER AND METHOD WITH HAZARD DETECTION

[75] Inventors: Richard D. Smith, Palo Alto; Ronald R. Lentz, Modesto; Patrick C. Meachim, Oakdale, all of Calif.

[73] Assignee: Electric Power Research Institute, Palo Alto, Calif.

[21] Appl. No.: 546,878

[22] Filed: Oct. 23, 1995

[51] Int. Cl.[6] ..... F26B 3/34

[52] U.S. Cl. ..... 34/261; 34/260

[58] Field of Search ..... 34/260, 261

[56] References Cited

U.S. PATENT DOCUMENTS 4,223,692 8/1980 Perry ..... 137/78.4

5,270,509 12/1993 Gerling ..... 219/10.55 B 5,396,715 3/1995 Smith .

*Primary Examiner*—Henry A. Bennett

*Assistant Examiner*—Dinnatia Doster

*Attorney, Agent, or Firm*—Flehr, Hohbach, Test, Albritton & Herbert

[57] ABSTRACT

Microwave clothes dryer and method in which an impending fire and/or explosion is detected by monitoring gases from the drying chamber with a solid state gas sensor to detect the presence of a gas associated with fire or an explosion. In the disclosed embodiments, the gases to be detected include ethane, propane, butane, toluene, hydrogen sulfide, alcohol, and combinations thereof.

20 Claims, 1 Drawing Sheet

MICROWAVE CLOTHES DRYER AND METHOD WITH HAZARD DETECTION

This invention pertains generally to clothes dryers and, more particularly, to clothes dryers using microwave energy to vaporize water and to the prevention of fires and explosions in clothes dryers.

Metallic objects can overheat and ignite the fabric adjacent to them in a microwave clothes dryer. The problem usually does not exist with the buttons and zippers which are commonly used in clothing because they do not heat enough to produce ignition. However, other metallic objects such as bobby pins, bread ties, nails and pencils will heat sufficiently to burn cloth adjacent to them and can lead to a fire within a dryer.

Butane cigarette lighters pose an even more serious problem because when heated in a microwave field, they can release their fuel, presenting both a fire hazard and the possibility of an explosion.

Heretofore, there have been some efforts to avoid fires in clothes dryers. U.S. Pat. No. 5,396,715, for example, describes a system in which the drying chamber is deluged with water in the event that a fire is detected. In that system, the outbreak of a fire is detected by a combination of an infrared sensor, a fume detector and a temperature sensor. This approach, however, has certain limitations and disadvantages. Tumbling clothes can shield the infra red sensor from the hot spots it is supposed to detect, and the fire may already be out of control by the time the temperature sensor detects it.

It is in general an object of the invention to provide a new and improved system and method for preventing fires and/or explosions in clothes dryers.

Another object of the invention is to provide a system and method of the above character which are particularly suitable for use in microwave clothes dryers.

These and other objects are achieved in accordance with the invention by providing a microwave clothes dryer and method in which an impending fire and/or explosion is detected by monitoring gases from the drying chamber with a solid state gas sensor to detect the presence of a gas associated with fire or an explosion. In the disclosed embodiments, the gases to be detected include ethane, propane, butane, toluene, hydrogen sulfide, alcohol, and combinations thereof.

Figure 1:
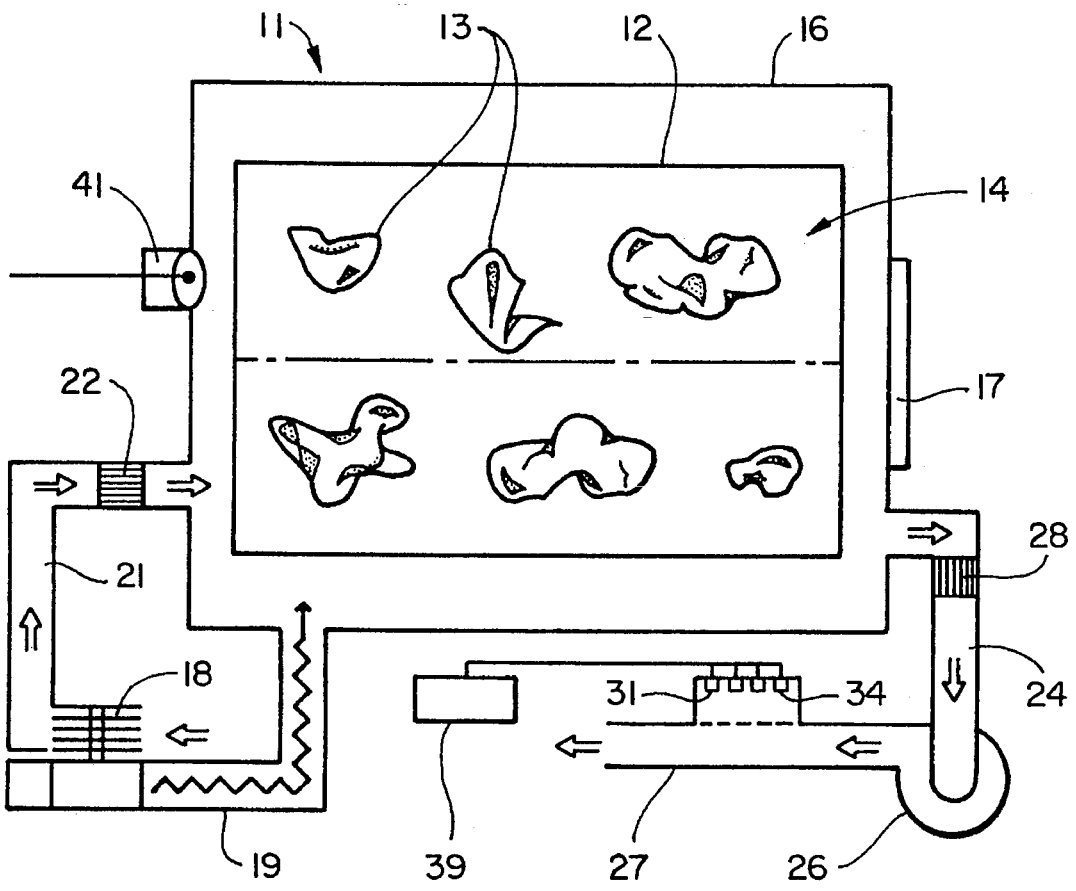
FIG. 1 is a cross-sectional view, somewhat schematic, of one embodiment of a microwave clothes dryer incorporating the invention.
Figure 2:
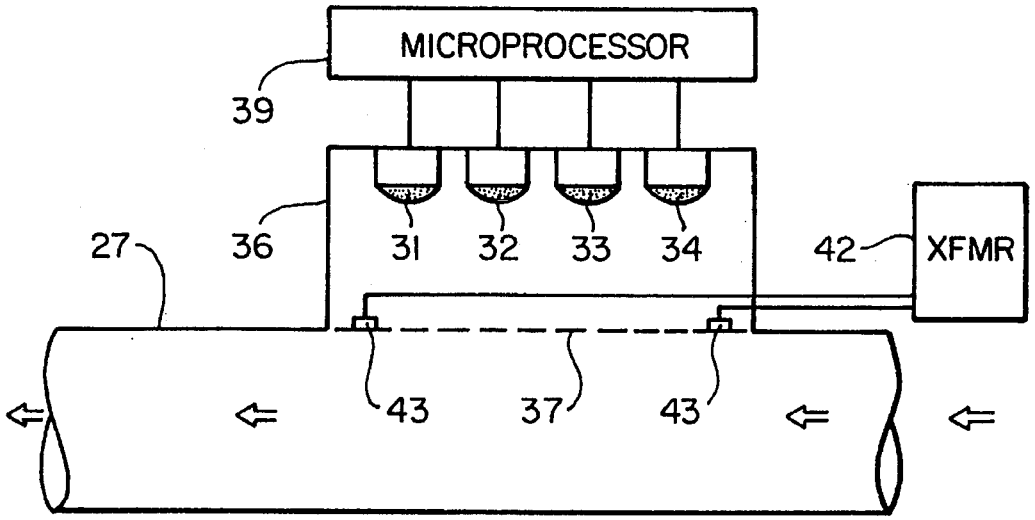
FIG. 2 is a more detailed view of a portion of the embodiment of FIG. 1.

In the drawing, the invention is illustrated in connection with a microwave dryer 11 having a rotating drum 12 for holding clothes 13 to be dried within a chamber 14. The chamber is surrounded by a metal enclosure, or Faraday cage, 16 which prevents microwaves from escaping from the dryer. A door 17 in the enclosure provides access to the drum for insertion and removal of the clothes.

Microwave energy for evaporating water in the clothes is generated by a magnetron 18 and supplied to the chamber through a waveguide 19. Heated air is supplied to the chamber through an inlet duct 21. In the embodiment illustrated, the air is preheated by waste heat from the magnetron. If desired, it can be further heated by an electrical resistance heater or a gas flame (not shown). A choke or barrier 22 at the outlet end of the inlet duct prevents microwave energy from escaping from the chamber through the duct.

As the air passes through the tumbling clothes, it picks up moisture which has been vaporized by the microwaves. This moisture laden air is removed from the chamber through an exhaust system which includes an exhaust duct 24, an induced draft fan 26 and an exit pipe 27. A lint filter 28 is provided toward the inlet end of the exhaust duct, and the moisture laden air leaving the exit pipe is discharged to the atmosphere.

Means is provided for detecting the presence of gases associated with hazards such as fires and explosions. That means includes a plurality of solid state gas sensors 31–34 which are mounted in a box 36 adjacent to exit pipe 27. The interior of the box communicates with the interior of the pipe through an inconel screen 37. The air from the exit pipe flows through the screen and swirls within the box, driven by the turbulence of the stream. The swirling air contacts the gas sensors.

In one presently preferred embodiment, four solid state gas sensors are employed in order to have a broad capability to detect gas species and also to provide redundancy. The gases detected by these sensors include ethane, propane, butane, toluene, hydrogen sulfide and alcohol. The following detectors manufactured by the Figaro Company of Japan have been found to give particularly satisfactory results in this application:

Figaro Number 842—Ethane, Propane & Butane

Figaro Number 822—Toluene

Figaro Number 825—Hydrogen Sulfide

Figaro Number 882—Alcohol

These sensors are n-type semiconductor bulk devices which are mainly composed of $SnO_2$ (tin oxide) whose conductivity increases in the presence of the specified gases in air.

The outputs of the four solid state gas sensors are input individually to a microprocessor 39 which is programmed to monitor the levels of the four signals, take the first derivative of each of the signals and provide an alarm signal if any one or more of the signal levels or the first derivatives exceeds a predetermined threshold value. That signal is applied to a control circuit, e.g. a relay or a solid state switching device, (not shown) which shuts down the dryer.

Additional protection against fires is provided by an arc detector 41 which is mounted in a wall of the dryer chamber to detect arcing within the chamber. This detector is connected to control circuitry (not shown) which shuts down the dryer in the event that arcing is detected.

The air leaving the dryer chamber contains very fine lint particles which pass through the lint filter 28. These particles are intercepted by the inconel filter 37 which prevents them from collecting on and eventually plugging up the solid state gas sensors.

Build-up of lint on the inconel filter is prevented by applying a voltage to the filter screen at the end of each dryer cycle to heat the screen and burn off the lint which has collected during the cycle. This voltage is applied by a transformer 42 connected to the screen through terminals 43.

Operation and use of the system, and therein the method of the invention, are as follows. Clothes to be dried are placed in the drum, the door is closed, and the dryer is turned on. During normal operation, the microwave energy evaporates the water in the clothes, and the moisture is carried out of the chamber by the flow of hot air.

The solid state gas sensors monitor the airstream leaving the chamber. In the event that a gas associated with a fire or an explosion is detected, an alarm is given, and the dryer is shut down. In the event that arcing is detected in the chamber, the dryer is likewise shut down.

The system has been found to be quite effective in detecting gases associated with fires and explosions and shutting down the dryer before any real damage can occur. When a fabric is overheated, it undergoes a thermal breakdown and emits gases which can be detected to shut down the dryer before a fire actually breaks out. In a test setup, clothes were dried in a microwave chamber and allowed to overheat. The solid state gas sensors detected the overheating so quickly that only slight scorching of the clothes occurred.

The invention can be applied to conventional electric and gas powered clothes dryers as well as to microwave dryers. In such applications, however, only the solid state gas sensors would be needed since arcing does not normally occur in such dryers.

It is apparent from the foregoing that a new and improved system and method have been provided for detecting hazards such as fires and explosions in clothes dryers. While only certain presently preferred embodiments have been described in detail, as will be apparent to those familiar with the art, certain changes and modifications can be made without departing from the scope of the invention as defined by the following claims.

We claim:

1. In a microwave clothes dryer: a chamber for holding clothes to be dried, means for introducing microwave energy into the chamber to evaporate moisture in the clothes, a plurality of gas sensors each adapted to detect the presence of a different gas selected from the group consisting of ethane, propane, butane, toluene, hydrogen sulfide, alcohol, and combinations thereof in the chamber, and means responsive to the gas sensors for delivering an alarm signal in the event that one of the gases in the group is detected.

2. The clothes dryer of claim 1 further including an arc detector for detecting arcing in the chamber.

3. In a method of drying clothes, the steps of: placing the clothes in a drying chamber, introducing microwave energy into the chamber to evaporate moisture in the clothes, monitoring gases from the chamber with a plurality of gas sensors each of which is adapted to detect the presence of a different gas selected from the group consisting of ethane, propane, butane, toluene, hydrogen sulfide, alcohol, and combinations thereof in the chamber, and delivering an alarm signal in the event that one of the gases in the group is detected.

4. The method of claim 3 further including the step of detecting arcing in the chamber.

5. In a clothes dryer: a chamber for holding clothes to be dried, means for introducing microwave energy into the chamber to evaporate moisture in the clothes, a plurality of solid state gas sensors each adapted to detect the presence of a different predetermined gas associated with thermal breakdown of fabric in the clothes, and means responsive to the gas sensors for delivering an alarm signal in the event that one of the predetermined gases is detected.

6. The clothes dryer of claim 5 including an additional solid state gas sensor for detecting a gas associated with an impending explosion in the chamber.

7. The clothes dryer of claim 6 wherein the solid state gas sensors are adapted to detect gases selected from the group consisting of ethane, propane, butane, toluene, hydrogen sulfide, alcohol, and combinations thereof.

8. The clothes dryer of claim 7 further including an arc detector for detecting arcing in the chamber.

9. In a method of drying clothes, the steps of: placing the clothes in a drying chamber, introducing microwave energy into the chamber to evaporate moisture in the clothes, monitoring gases from the chamber with a plurality of solid state gas sensors each adapted to detect the presence of a different predetermined gas associated with thermal breakdown of fabric in the clothes, and delivering an alarm signal in the event that one of the predetermined gases is detected.

10. The method of claim 9 further including the step of monitoring the gases from the chamber with an additional solid state gas sensor to detect the presence of a gas associated with an impending explosion in the chamber.

11. The method of claim 10 wherein the gases from the chamber are monitored to detect the presence of a gas selected from the group consisting of ethane, propane, butane, toluene, hydrogen sulfide, alcohol, and combinations thereof.

12. The method of claim 9 further including the step of detecting arcing in the chamber.

13. In a clothes dryer: a chamber for holding clothes to be dried, means for introducing energy into the chamber to evaporate moisture in the clothes, a plurality of solid state gas sensors each adapted to detect the presence of a different predetermined gas associated with thermal breakdown of fabric in the clothes, and means responsive to the gas sensors for delivering an alarm signal in the event that one of the predetermined gases is detected.

14. The clothes dryer of claim 13 including an additional second solid state gas sensor for detecting a gas associated with an impending explosion in the chamber.

15. The clothes dryer of claim 14 wherein the solid state gas sensors are adapted to detect gases selected from the group consisting of ethane, propane, butane, toluene, hydrogen sulfide, alcohol, and combinations thereof.

16. The clothes dryer of claim 13 further including an arc detector for detecting arcing in the chamber.

17. In a method of drying clothes, the steps of: placing the clothes in a drying chamber, introducing energy into the chamber to evaporate moisture in the clothes, monitoring gases from the chamber with a plurality of solid state gas sensors each adapted to detect the presence of a different predetermined gas associated with thermal breakdown of fabric in the clothes, and delivering an alarm signal in the event that one of the predetermined gases is detected.

18. The method of claim 17 further including the step of monitoring the gases from the chamber with an additional solid state gas sensor to detect the presence of a gas associated with an impending fire in the chamber.

19. The method of claim 18 wherein the gases from the chamber are monitored to detect the presence of a gas selected from the group consisting of ethane, propane, butane, toluene, hydrogen sulfide, alcohol, and combinations thereof.

20. The method of claim 17 further including the step of detecting arcing in the chamber.

* * * * *